US006315603B1

(12) United States Patent
Miura et al.

(10) Patent No.: US 6,315,603 B1
(45) Date of Patent: Nov. 13, 2001

(54) ELECTRICAL CONNECTOR FOR FLAT CABLE

(75) Inventors: Kazuto Miura; Hiroshi Yamane, both of Kanagawa; Shinji Uchida, Tokyo, all of (JP)

(73) Assignee: J.S.T Mfg. Co., LTD, Osaka (JP)

( * ) Notice: Subject to any disclaimer, the term of this patent is extended or adjusted under 35 U.S.C. 154(b) by 0 days.

(21) Appl. No.: 09/630,603

(22) Filed: Aug. 1, 2000

(30) Foreign Application Priority Data

Aug. 3, 1999 (JP) ..... 11-220284

(51) Int. Cl.[7] ..... H01R 12/24
(52) U.S. Cl. ..... 439/495; 439/260
(58) Field of Search ..... 439/495, 496, 439/492, 499, 357, 358, 260

(56) References Cited

U.S. PATENT DOCUMENTS 3,084,302 * 4/1963 Braeutigam ..... 439/496
3,149,897 * 9/1964 Martineck ..... 439/495
5,354,214 * 10/1994 Aso et al. ..... 439/495
5,882,223 * 3/1999 Igarashi ..... 439/495
6,155,864 * 12/2000 Yoshiura ..... 439/357

FOREIGN PATENT DOCUMENTS

UM6-82783 11/1994 (JP) .
7-106028 4/1995 (JP) .
9-283236 10/1997 (JP) .

* cited by examiner

*Primary Examiner*—Tho D. Ta
(74) *Attorney, Agent, or Firm*—Rader, Fishman & Grauer, PLLC

(57) ABSTRACT

An electrical connector for flat cable which removably connects a flat cable at its end. A housing defines an insertion space for insertion of the end of the flat cable in a predetermined direction. A retainer is connected to the housing as allowed to slide substantially along the predetermined direction. A reinforcement member made of metal is fixed to the housing. The reinforcement member inhibits the removal of the retainer from the housing.

12 Claims, 8 Drawing Sheets

ELECTRICAL CONNECTOR FOR FLAT CABLE

CROSS REFERENCE TO RELATED APPLICATION

This application claims the benefit under 35 U.S.C. §119 of Japanese Patent Application No.11-220284, the abstract of disclosure of which is incorporated herein by reference.

BACKGROUND OF THE INVENTION

1. Field of the Invention

The present invention relates to an electrical connector for flat cable for connecting a flexible board such as called FPC (Flexible Printed Circuit) board or a flat cable such as FFC (Flexible Flat Cable) to a circuit board.

2. Description of Related Arts

As a slide-type retainer (hereinafter, simply referred to as "slider") used in the connectors of this type, various types have been proposed which are formed of a synthetic resin material as a whole and include a transversely extended main body having an insertable projection and a pair of connection arms extended therefrom (see, for example, Japanese Utility Model Laid-Open Gazette No. 6-82783 (1994) and Japanese Patent Laid-Open Gazette No. 9-283236(1997). Along with an FPC board (flexible printed circuit board), the insertable projection is inserted in an insertion space of a synthetic-resin housing retaining a group of contacts, thereby pressing the FPC board into contact with the contact group. On the other hand, the pair of connection arms serve to interconnect the housing and the retainer, as extended from transversely opposite ends of the main body along lateral side surfaces of the housing in a manner to sandwich the insertable projection therebetween.

The connection arms of the retainer are slidably received by guide grooves formed at lateral sides of the housing. With the connection arms drawn out to limit (moved to forward position), engaged sections formed at the connection arms are engaged with anti-deviation stoppers provided in the guide grooves, whereby the retainer is prevented from being drawn any further.

Unfortunately, the deviation of the connection arms is prevented by way of the engagement between the synthetic resin members, which engagement tends to become loose. As a result, the synthetic resin members fail to positively prevent the deviation of the arms.

It may be contemplated to increase the anti-deviation stopper in the engagement height. However, a problem exists with the assembly work of a connector of this arrangement, which includes the assembling of the connection arms in the guide grooves. In order to assemble the connection arms in the housing, the arms must be resiliently deformed for allowing their engaged sections to slide over the anti-deviation stoppers of the housing. Unfortunately, a great amount of deformation of the connection arms may result in plastic deformation thereof.

SUMMARY OF THE INVENTION

In view of the foregoing, it is an object of the invention to provide an electrical connector for flat cable ensuring positive prevention of the deviation of the connection arms.

According to a preferred mode of the invention for achieving the above object, an electrical connector for flat cable for removably connecting a flat cable at its end comprises a housing defining an insertion space for insertion of the flat cable in a predetermined direction, a retainer connected to the housing as allowed to slide in the predetermined inserting direction, and a reinforcement member made of metal and fixed to the housing, wherein the reinforcement member includes inhibition means for inhibiting removal of the retainer from the housing. This arrangement utilizes the metallic member for preventing the deviation of the retainer, thus accomplishing reliable prevention of the deviation of the retainer.

Preferably, the reinforcement member is soldered to a circuit board so as to be fixed thereto. This results in the positive prevention of the deviation of the retainer. The reinforcement member soldered to the circuit board is normally disposed at the connector mounted on the circuit board surface. Therefore, the number of components is not increased.

Preferably, the retainer includes an insertable projection slidably inserted in the insertion space, and a pair of connection arms slidably received by a pair of slide grooves of the housing for connection with the housing, whereas the insertable projection includes a pressing portion for pressing an end of the flat cable in the insertion space into contact with a group of contacts. This arrangement positively prevents the connection arms from deviating from the slide grooves.

BRIEF DESCRIPTION OF THE DRAWINGS

FIG. 9A is a sectional view showing the connector with the connection arm inclined in a slide groove, whereas

DETAILED DESCRIPTION OF THE PREFERRED EMBODIMENTS

Preferred embodiments of the invention will be described with reference to the accompanying drawings.

Figure 1:
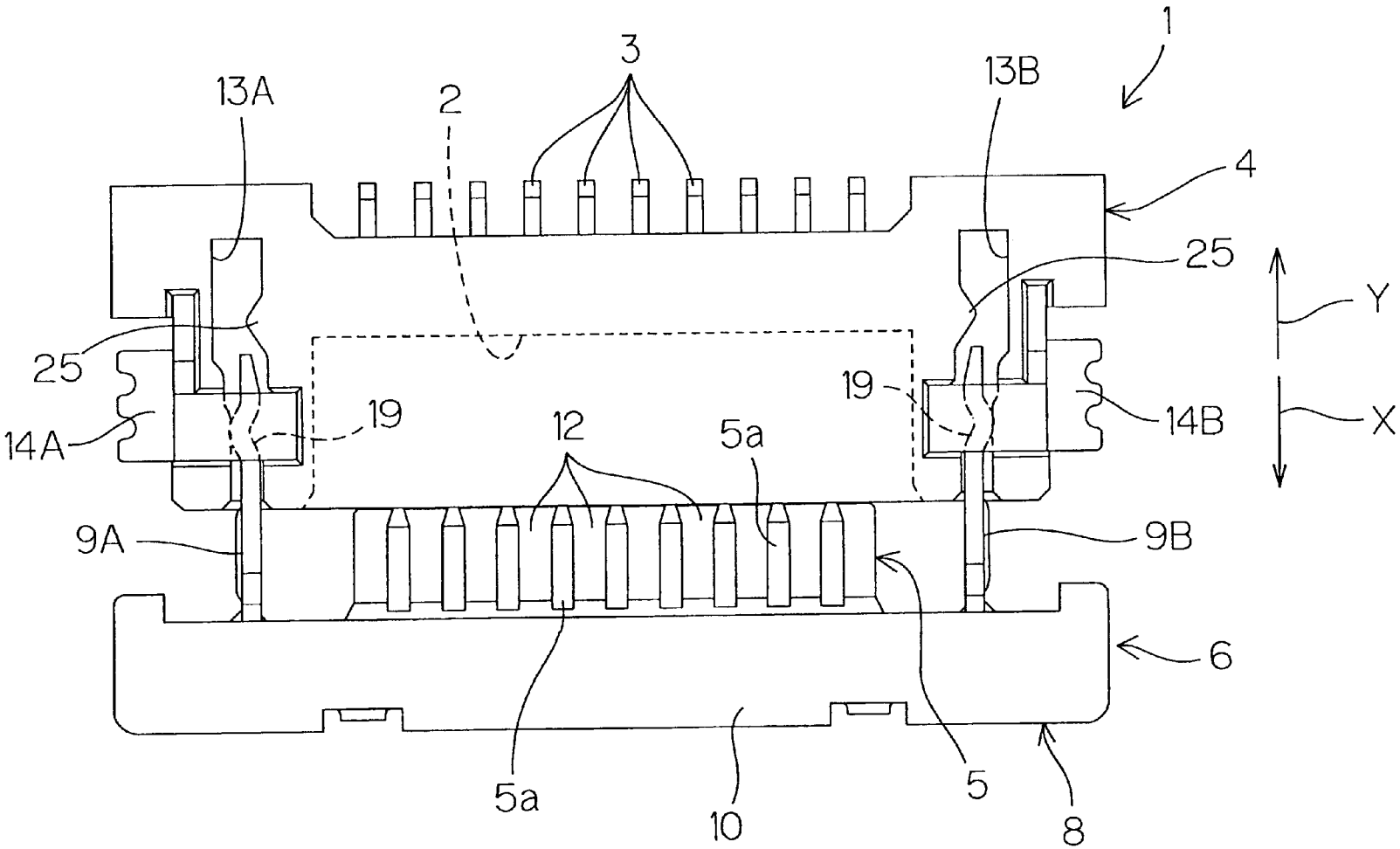
FIG. 1 is a plan view showing an electrical connector according to one embodiment of the invention with a slide-type retainer (hereinafter, referred to as "slider") drawn out.
Figure 2:
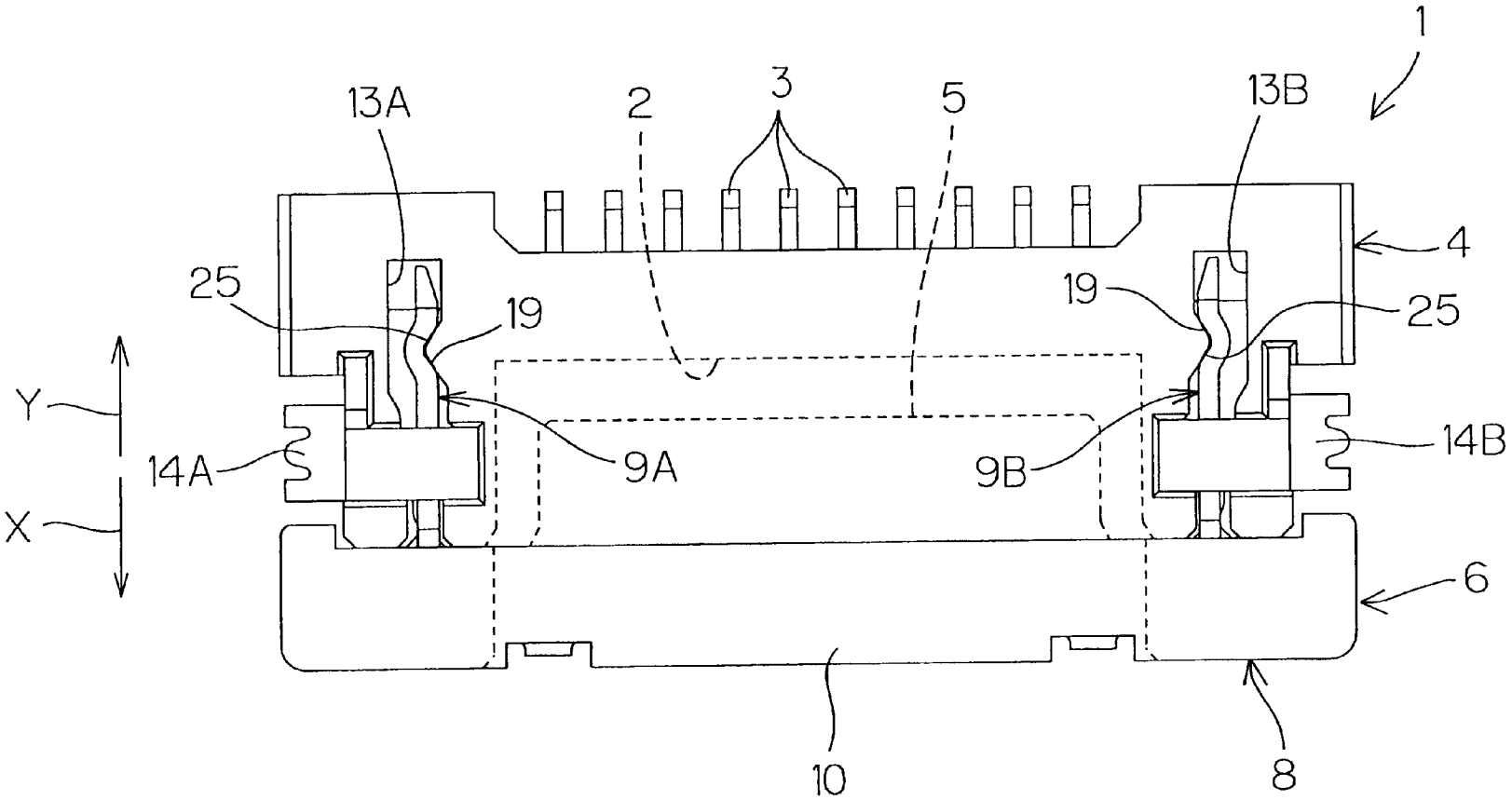
FIG. 2 is a plan view showing the connector with the slider inserted.
Figure 3B:
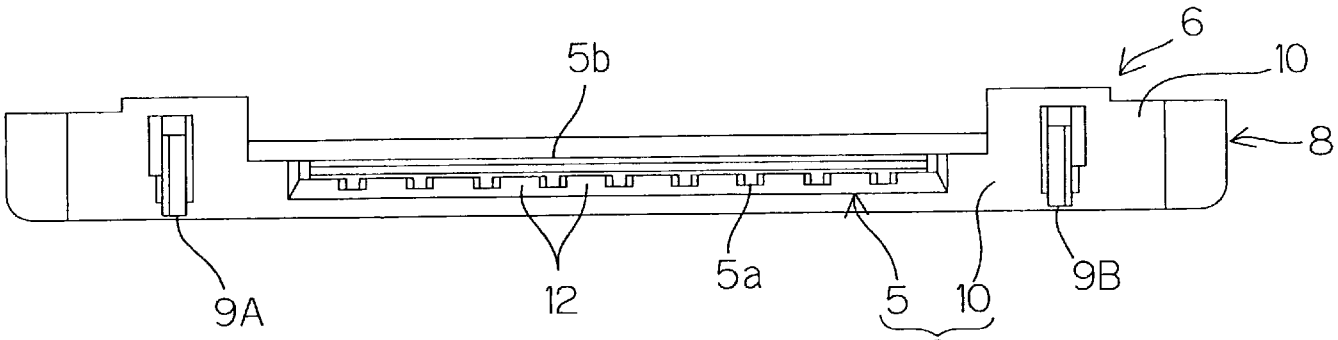
FIGS. 3A and 3B are a plan view and rear view of the slider.

Referring to FIGS. 1 and 2, a connector 1 according to one embodiment hereof includes a housing 4 retaining a plurality of contacts 3 transversely arranged in its insertion space 2 opening in a forward direction X, and a slider 6 having an insertable projection 5 to be inserted in or removed from the insertion space 2 of the housing 4. The insertable projection 5 is inserted into the insertion space 2 in a predetermined insertion direction (equivalent to a rearward direction Y) together with an FPC 7 as the flat cable (see FIGS. 7 and 9B). At the deepest position in the insertion direction Y, the insertable projection presses the FPC 7 into contact with the plural contacts 3 by means of its lower surface 5*b*, shown in FIGS. 3B, 5 and 7, serving as a pressing portion.

The slider 6 includes a main body 8 formed of a synthetic resin, and a pair of connection arms 9A, 9B, made of metal, which are mirror images of each other. The connection arms 9A, 9B are independent from each other and partially embedded in the main body 8 by insert molding. The main body 8 includes an elongate body section 10 extended transversely, and the insertable projection 5 extended from the body section 10. The insertable projection 5 is formed with receiving grooves 12 in its upper surface 5*a*, which individually correspond to fixing pieces 11 (FIG. 7) of fork-shaped portions of the contacts 3 (see FIGS. 1, 3A and 3B).

Turning to FIGS. 1 and 2, the housing 4 includes a pair of symmetrical slide grooves 13A, 13B opening in the forward direction X and an upward direction W (FIG. 4), the grooves located laterally opposite places with respect to the insertion space 2. As shown in FIGS. 1 and 2, the connection arms 9A, 9B of the slider 6 are adapted to slide in the forward direction X and the rearward direction Y (the directions to remove and insert the insertable projection 5) as received by the corresponding slide grooves 13A, 13B. The connection arms are also prevented from deviating from the slide grooves 13A, 13B by corresponding reinforcement tabs 14A, 14B made of metal. The reinforcement tabs 14A, 14B are symmetrically shaped. After the connection arms 9A, 9B are inserted in the slide grooves 13A, 13B, the reinforcement tabs are press-inserted from above to be fixed to given places of the housing 4 in a manner to span the respective slide grooves 13A, 13B.

As seen in FIG. 1, the connection arms 9A, 9B each include a lock section 19. As shown in FIG. 2, the lock sections 19 come into engagement with corresponding engageable extensions 25 disposed in the slide grooves 13A, 13B, thereby locking the slider 6 to the housing 4.

Figure 4:
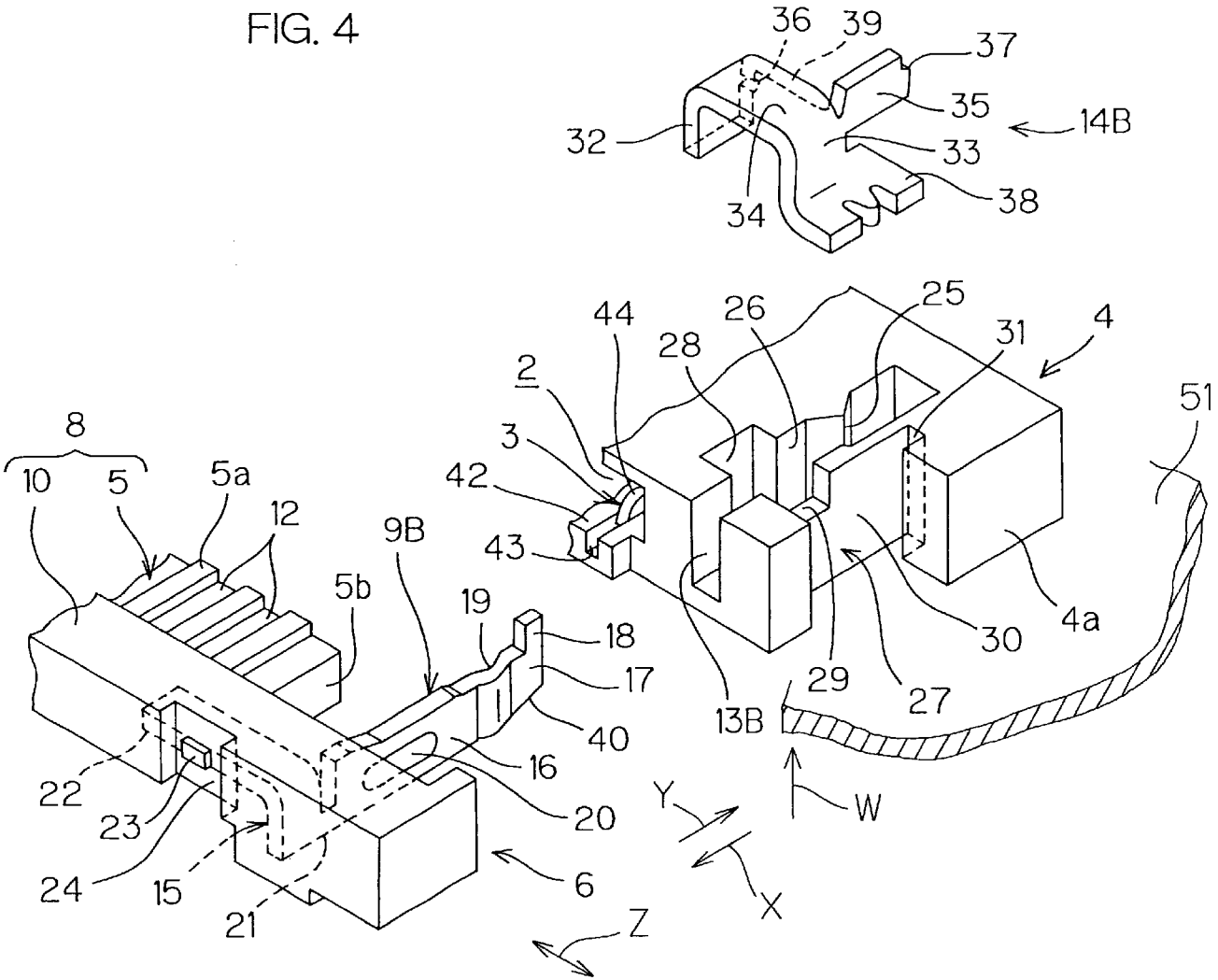
FIG. 4 is an exploded perspective view showing the slider, a housing and a reinforcement tab.
Figure 7:
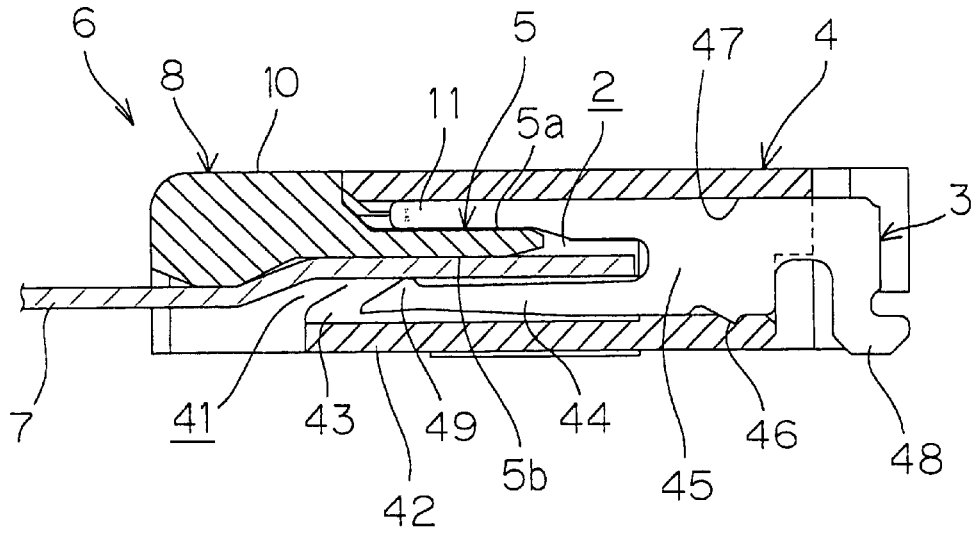
FIG. 7 is a sectional view showing the connector with the slider and an FPC inserted therein.
Figure 9A:
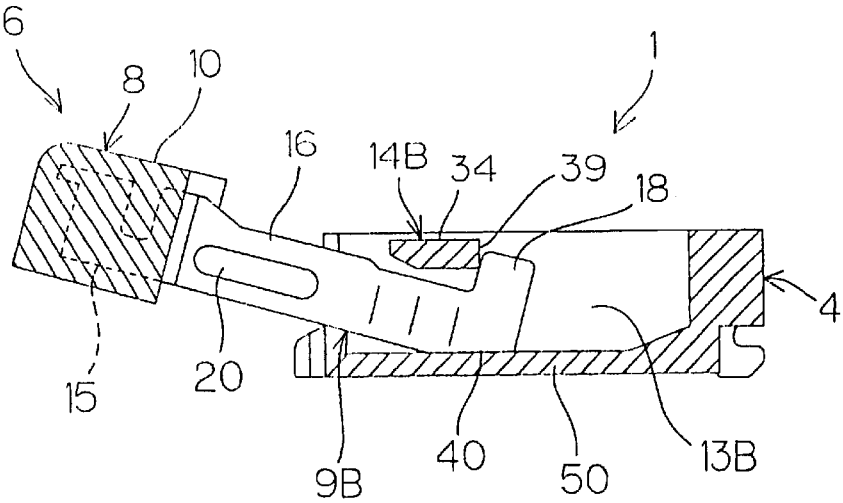
Figure 9B:
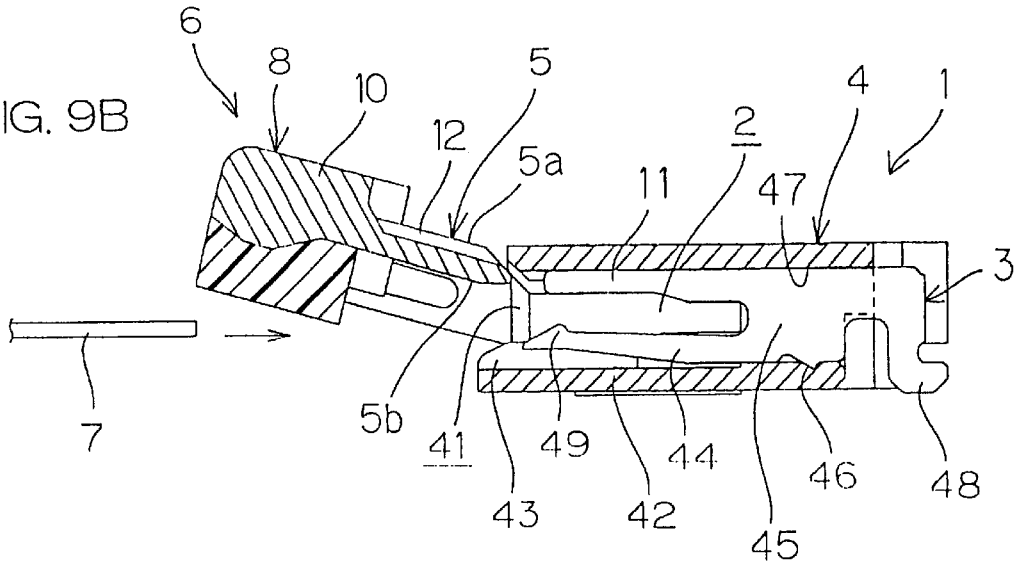
FIG. 9B is a sectional view showing the connector with an insertable projection inclined in an insertion space in association with the state of FIG. 9A.

Referring to FIG. 4 and FIGS. 7 and 9B showing the connector in section, the contact 3 includes a resilient piece 44 inserted in a receiving groove 43 formed in a top surface of a lower plate 42 of the housing 4, and the fixing piece 11 disposed above the resilient piece 44 to form the fork shape jointly with the resilient piece 44. The fixing piece 11 and the resilient piece 44 have their rear end portions interconnected by a main body 45. The main body 45 includes a locking projection 46 wedgingly engaging the lower plate 42. The main body 45 is press-inserted, from rear, into a fixing hole 47 of the housing 4 to be fixed therein. The main body 45 also has a substantially L-shaped lead portion 48 extended from an upper part of a rear end thereof. The lead portion 48 is soldered to a board surface on which the connector 1 is mounted. A chevron-shaped projection 49 ensures contact pressure by pressing against the inserted FPC 7. In FIGS. 7 and 9B, an unhatched area represents the section of the contact 3.

Figure 3A:
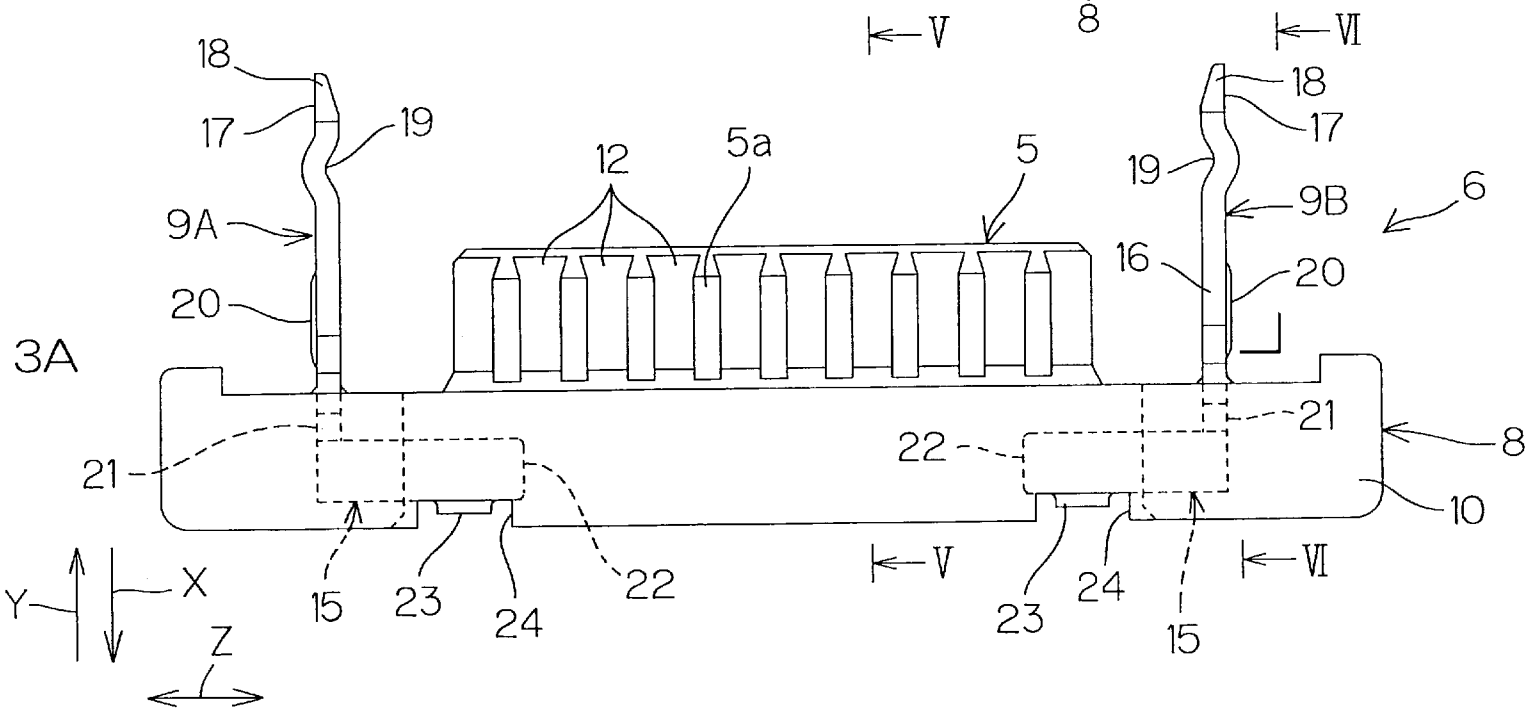
Figure 5:
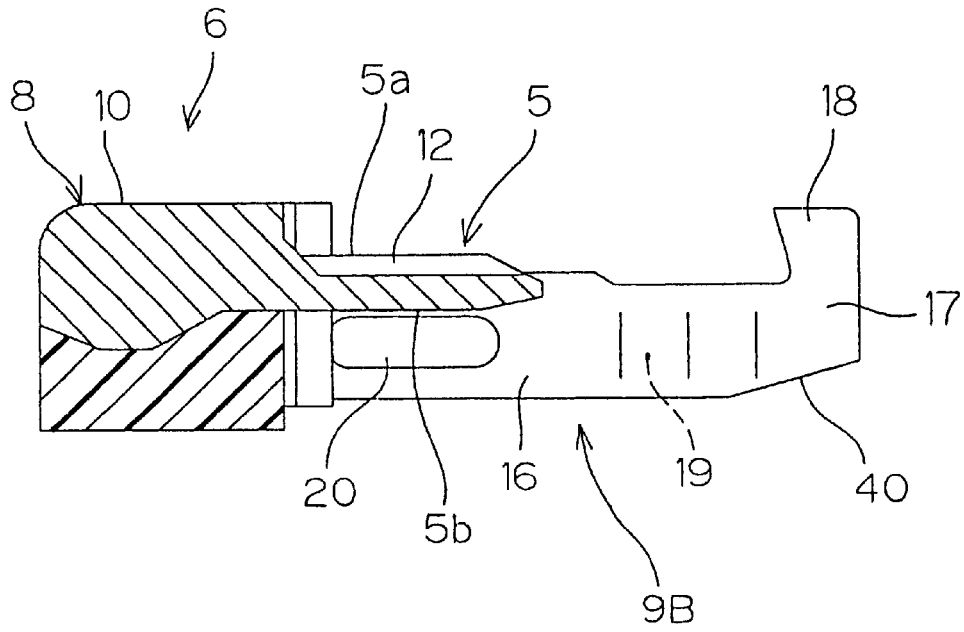
FIG. 5 is a sectional view taken on the line V—V in FIG. 3A.
Figure 6:
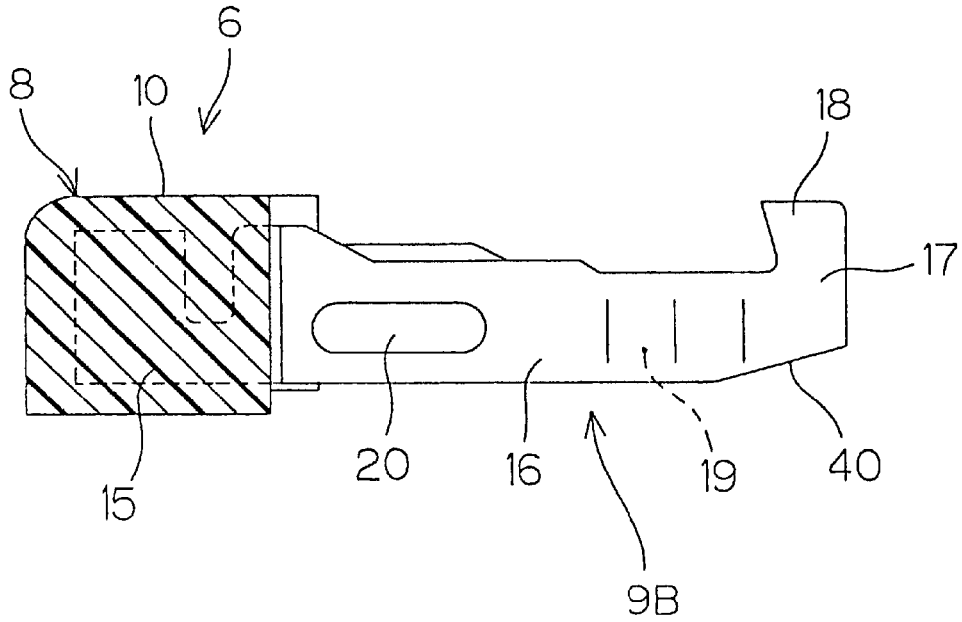
FIG. 6 is a sectional view taken on the line VI—VI in FIG. 3A.

Next, referring to FIG. 3A, an exploded perspective view of FIG. 4, FIG. 5 representing a sectional view taken on the line V—V in FIG. 3A and FIG. 6 representing a sectional view taken on the line VI—VI in FIG. 3A, the connection arms 9A, 9B of the slider 6 are each formed of a sheet metal into shape, including a buried portion 15 buried in the body section 10 of the main body 8, and a projecting portion 16 extended outwardly of the body section 10 in parallel relation with the insertable projection 5. The projecting portion 16 extends in the sliding direction Y.

The buried portion 15 includes a first section 21 coplanar with the projecting portion 16 and extended in the sliding direction X, and a second section 22 extended in a direction Z crossed by the sliding direction X as bent square to the first section 21. In forming a sheet metal, a substantially L-shaped piece of flat sheet metal in development is worked in such a manner that one part thereof (defining the second section 22) is bent square to the other part (defining the projecting portion 16 and the first section 21 of the buried portion 15). Since the buried portion 15 includes the bent section (the second section) extended in the direction Z crossed by the sliding direction X, the connection arm 9A, 9B is positively prevented from deviating from the body section 10.

The projecting portion 16 extends parallel to a side surface 5*b* of the insertable projection 5 (or parallel to a side surface 4*a* of the housing 4). A distal end 17 of the projecting portion 16 defines a hook portion 18 projected upward in a hook-like fashion. The distal end 17 of the projecting portion 16 is tapered at its lower side which thus defines a slope 40 inclined upward toward the end.

The connection arm 9B(9A) can be inclined by bringing the slope 40 into intimate contact with a lower plate 50 of the slide groove 13B, as shown in FIG. 9A. Therefore, a relatively large entrance to an introduction space 41 for the FPC 7 may be defined below the insertable projection 5 in the insertion space 2, as shown in FIG. 9B. This facilitates the insertion of the FPC 7.

The connection arms 9A, 9B are formed with the lock sections 19 near the respective distal ends 17 thereof, the lock sections being comprised of a recess and disposed in face-to-face relation. With the insertable projection 5 positioned to press the FPC 7 into contact with the plural contacts 3, the lock sections 19 are in engagement with the engageable extensions 25 in the slide grooves 13A, 13B of the housing 4 thereby locking the slider 6 to the housing 4. In a process where the slider 6 drawn out to limit, as shown in FIG. 1, is inserted deepest in the housing, as shown in FIG. 2, the connection arms 9A, 9B are resiliently distended so as to allow the distal ends 17 of the projecting portions 16 to slide over the corresponding engageable extensions 25, thereby bringing their lock sections 19 into engagement with the engageable extensions 25, as shown in FIG. 2. Indicated at 20 is a bead portion comprised of a hollow projected rib for reinforcement of the projecting portion 16.

The first section 21 of each buried portion 15 is of a vertical plate continuous to the projecting portion 16, whereas the second section 22 is of a horizontal plate bent into square along a line corresponding to an upper edge of the first section 21 and extended toward the counterpart buried portion 15. The second section 22 includes a projection 23, which is exposed outside via a recess 24 formed in the body section 10. The projection 23 is used for retaining the connection arm 9A, 9B at place during molding so as to prevent the connection arm from being displaced in molding dies. That is, the connection arm 9A, 9B with high positional precisions may be obtained because the connection arm 9A, 9B is retained at both a part defining the projecting portion 16 and a part defining the projection 23 during the insert molding thereby ensuring the prevention of displacement thereof.

Turning to FIG. 4, the slide groove 13B extends parallel with the side surface 4*a* of the housing 4. As mentioned supra, the slide groove opens in the forward direction X and the upward direction W for receiving the corresponding connection arm 9B from front. Out of opposite side walls 26, 27 of the slide groove 13B, the one 26 away from the side surface 4*a* is vertically formed with a first press-fit groove 28 at place closer to its front end, the groove 28 communicating with the slide groove 13B and press-fittedly receiving the reinforcement tab. The side wall 26 is further formed with the engageable extension 25 at place closer to its rear end. The first press-fit groove 28 opens upward. The engageable extension 25 is of a chevron shape in section and vertically extended.

On the other hand, the side wall 27 closer to the side surface 4*a* is formed with a relief groove 29 at its upper part, corresponding to the position of the first press-fit groove 28. The side wall 27 is further formed with a second press-fit groove 30 comprised of a through groove for press-fittedly receiving the reinforcement tab, the groove extended along an overall vertical length of an outer side of the side wall 27. A large part of the press-fit groove 30 opens to the side surface 4*a* of the housing 4 so that only a rear part 31 thereof is defined by opposite side walls.

The reinforcement tab 14B is formed of a sheet metal into a ladle-like shape in front elevation. Specifically, the reinforcement tab 14B includes a first and second press-fitted sections 32, 33 as fixed portions to be press-fitted in the first and second press-fit grooves 28, 30, and an interconnection section 34 interconnecting respective upper ends of the first and second press-fitted sections 32, 33. The press-fitted section 33 includes an extension 35 extended rearwardly. The first press-fitted section 32 is formed with a press-fit projection 36 at its rear end surface, whereas a press-fit projection 37 is formed at a rear end surface of the extension 35 of the second press-fitted section 33. Further, a leg 38 is horizontally extended from a lower end of the second press-fitted section 33, as bent square thereto. The leg 38 is soldered to a conductive area of a printed circuit board 51. The leg is shaped like comb teeth for increased solderability.

Figure 8:
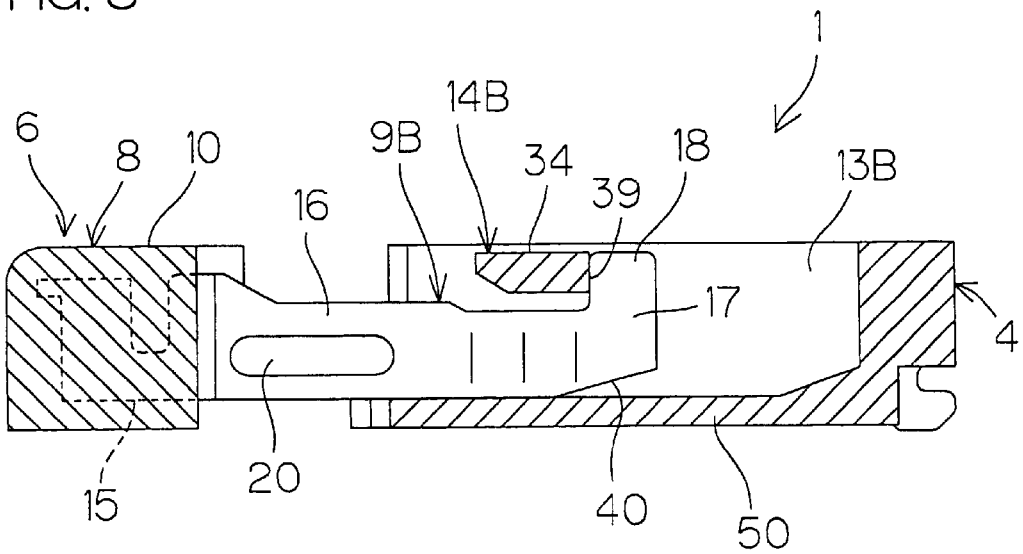
FIG. 8 is a sectional view showing the connector with the reinforcement tab preventing the deviation of the connection arm.

As shown in FIG. 8, a rear edge of the interconnection section 34 defines an anti-deviation engagement section 39 which engages the hook portion 18 of the connection arm 9B for preventing the connection arm 9B from displacing forward out of the slide groove 13B. The connection arm 9B is adapted to slide with a lower edge of the projecting portion 16 thereof guided by the lower plate 50 defining the bottom of the slide groove 13B, as shown in FIG. 8.

After the connection arm 9B is inserted, from front, into the slide groove 13B, the reinforcement tab 14B is mounted to the housing 4 in a manner that the first and second press-fitted sections 32, 33 are press-fitted in the first and second press-fit grooves 28, 30 of the housing 4, respectively. Thus, the reinforcement tab serves as the anti-deviation section for the connection arm 9B.

The embodiment of the invention is designed to prevent the deviation of the connection arms 9A, 9B by way of engagement between the hook portions 18 of the connection arms 9A, 9B and the anti-deviation engagement sections 39 of the reinforcement tabs 14A, 14B. Since the metallic members define the anti-deviation sections for the connection arms 9A, 9B, the deviation of the connection arms is positively prevented. In addition, the metallic reinforcement tabs 14A, 14B normally included in the connector mounted on the board surface are used as the metallic members defining the anti-deviation sections so that the number of components is not increased.

Furthermore, the reinforcement tab 14A, 14B is rigidly secured to the press-fit grooves 28, 30 of the housing 4 by press-fitting the pair of press-fitted sections 32, 33 thereof on the opposite sides of the interconnection section 34 including the anti-deviation engagement section 39, thus accomplishing a more reliable anti-deviation effect. Since the anti-deviation deviation effect is accomplished through the engagement between the metallic members, the connection arms 9A, 9B are more positively prevented from deviating.

The connection arms 9A, 9B are rigidly connected to the main body 8 because they are inserted in a synthetic resin being molded to form the main body 8. Besides, the connection arms 9A, 9B reduced in thickness and size permit the so-called inner-lock layout such as of the invention to be embodied in the connector 1 which need not be upsized. This contributes to the downsizing and thin design of the connector 1.

The slide grooves 13A, 13B opening forwardly and upwardly of the housing 4 and the press-fit grooves 28, 30 opening upwardly of the housing 4 allow for assembly steps of slidingly inserting the connection arms 9A, 9B of the slider 6 into the slide grooves 13A, 13B of the housing 4 from front and then press-fitting the reinforcement tabs 14A, 14B into the press-fit grooves 28, 30 of the housing 4 from above, resulting in the improved assemblability of the connector 1. Unlike the arrangements of the foregoing official gazettes, the arrangement of the embodiment does not involve the excessive deformation of the connection arms during assembly because the connection arms need not be slid over the anti-deviation stoppers.

Figure 10:
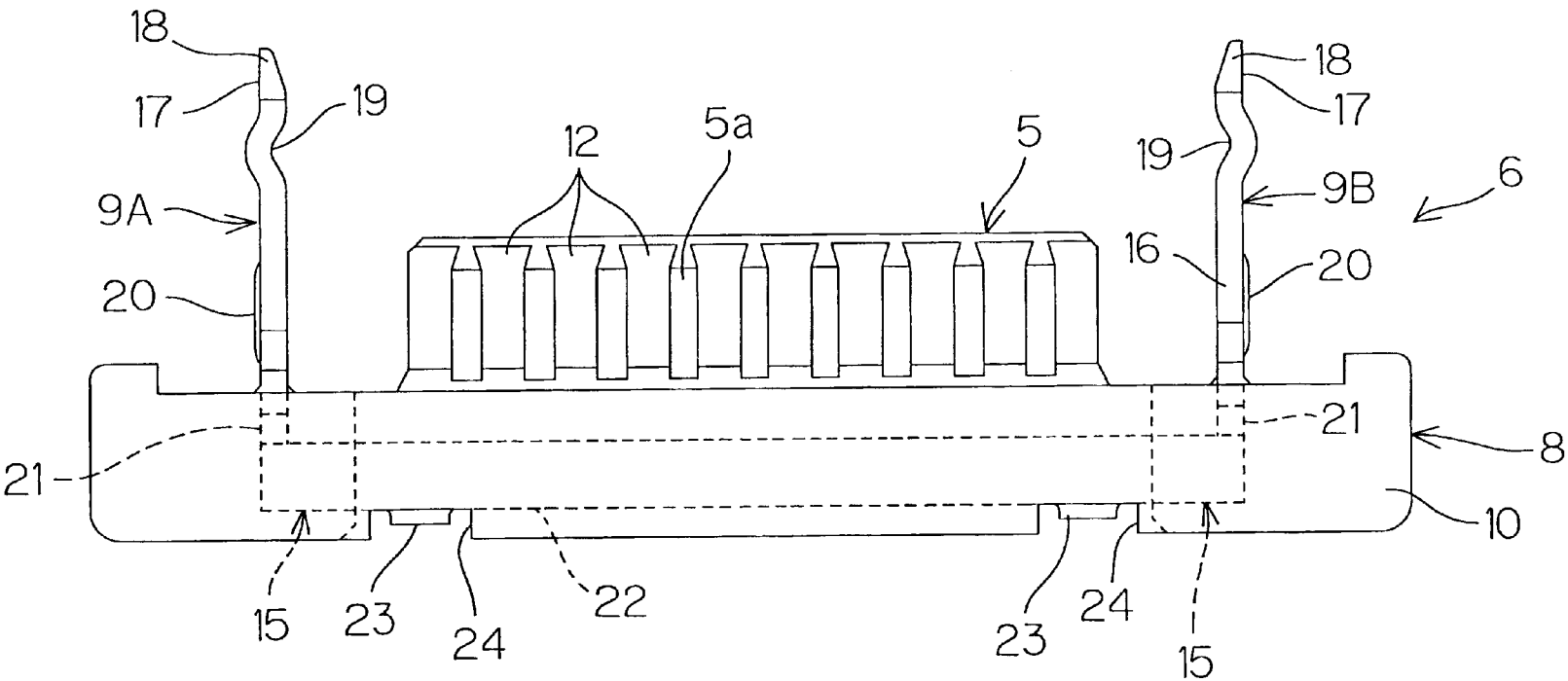
FIG. 10 is a plan view showing a slider according to another embodiment of the invention.

It is noted that the present invention is not limited to the foregoing embodiment. As shown in FIG. 10, for instance, the pair of connection arms 9A, 9B may be interconnected at the second sections 22 of their buried portions 15 so that the connection arms 9A, 9B may be formed of one piece member.

Alternatively, the connection arms may be formed of a synthetic resin into one piece combined with the main body of the slider.

The invention is also applicable to a layout of a non-inner lock type wherein the slide grooves open laterally of the housing.

In the foregoing embodiment, the connector is a so-called back-side contact type wherein a back side of the FPC 7 is pressed into contact with the contacts disposed thereunder. However, the invention is not limited to the above and the connector may be of a so-called top-side contact type wherein a top side of the FPC 7 is pressed into contact with the contacts disposed thereabove.

Although the foregoing embodiment is arranged such that the press-fit grooves open upwardly of the housing for press-fitting the reinforcement tabs from above the housing, the invention is not limited to this arrangement. Alternatively, the press-fit grooves may open downwardly of the housing for press-fitting the reinforcement tabs from below of the housing and fixed in places. In this case, the slide grooves also open downwardly.

The invention is also applicable to a so-called vertical-type connector wherein the housing 4 is laid out on the circuit board in a manner that the insertion space 2 opens upward for insertion or removal of the slider 6 from above.

Further, the reinforcement tab 14A, 14B may omit either one of the press-fitted sections 32, 33 thereof. Other various modifications may be contemplated within the scope of the invention.

What is claimed is:

1. An electrical connector for flat cable for removably connecting a flat cable at its end comprising:

a housing defining an insertion space for insertion of the flat cable in a predetermined direction and including a pair of slide grooves, each slide groove defined by opposed walls, a retainer connected to the housing as allowed to slide substantially in the predetermined direction, and including a pair of connection arms that are slidably received by said pair of slide grooves, and a reinforcement member made of metal and fixable within the respective slide groove of the housing, wherein the reinforcement member includes a member that inhibits the removal of the retainer from the housing.

2. The electrical connector for flat cable claimed in claim 1, wherein the reinforcement member is soldered to a circuit board.

3. The electrical connector for flat cable claimed in claim 1, wherein the reinforcement member includes an engagement section to be engaged with a hook portion disposed at each of the connection arms.

4. The electrical connector for flat cable claimed in claim 1, wherein the connection arms include a lock section, and the housing includes extensions that are disposed within the slide grooves and that engageable with the lock sections of the connection arms.

5. The electrical connector for flat cable claimed in claim 1, wherein each of said connection arms includes a sloped portion that engages with a bottom wall of said housing only when said retainer is allowed to slide substantially in the predetermined direction, each of said bottom walls connecting said opposing walls of said slide grooves.

6. The electrical connector for flat cable claimed in claim 1, wherein the retainer further includes an insertable projection slidably inserted in the insertion space, the insertable projection including a pressing portion for pressing an end of the flat cable inserted in the insertion space into contact with a plurality of contacts retained by the housing.

7. The electrical connector for flat cable claimed in claim 6, wherein the reinforcement member further includes a pair of fixing sections that are fixable to the housing, and an interconnection section interconnecting the pair of fixing sections and spanning the slide groove when fixed to the housing, and wherein the member that inhibits the removal of the retainer is disposed at the interconnection section.

8. The electrical connector for flat cable claimed in claim 7, wherein the member that inhibits the removal of the retainer includes an engagement section to be engaged with a hook portion disposed at each of the connection arms, and an edge of the interconnection section includes the engagement section.

9. The electrical connector for flat cable claimed in claim 7, wherein the fixing sections are fixed by press-fitting in corresponding press-fit grooves of the housing.

10. The electrical connector for flat cable claimed in claim 9, wherein the slide grooves and the press-fit grooves open to respectively receive the retainer and the connection arms in a direction crossed by the predetermined direction and the slide grooves also open in an opposite direction to the predetermined direction.

11. The electrical connector for flat cable claimed in claim 6, wherein the retainer possesses a synthetic-resin main body including the insertable projection, and wherein the connection arms are formed of metal and each include a buried portion embedded in the main body during the molding of the main body.

12. The electrical connector for flat cable claimed in claim 11, wherein each of the buried portions of the connection arms includes a bent section that is bent approximately at a square angle.

* * * * *